US008765005B2

(12) United States Patent
Kaneko

(10) Patent No.: US 8,765,005 B2
(45) Date of Patent: Jul. 1, 2014

(54) REFRIGERATOR OIL COMPOSITION

(75) Inventor: Masato Kaneko, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 189 days.

(21) Appl. No.: 13/026,689

(22) Filed: Feb. 14, 2011

(65) Prior Publication Data

US 2011/0133114 A1 Jun. 9, 2011

Related U.S. Application Data

(63) Continuation of application No. 12/093,727, filed as application No. PCT/JP2006/322009 on Nov. 2, 2006, now abandoned.

(30) Foreign Application Priority Data

Nov. 15, 2005 (JP) ..... 2005-330834

(51) Int. Cl.
*C09K 5/00* (2006.01)
*C09K 3/24* (2006.01)
*C10M 105/18* (2006.01)

(52) U.S. Cl.
USPC ..... 252/68; 508/579; 252/67; 62/302; 62/468

(58) Field of Classification Search
USPC ..... 568/679, 579, 623; 252/68, 73, 67; 508/579; 62/302, 468
See application file for complete search history.

(56) References Cited

U.S. PATENT DOCUMENTS

| | | | | |
|---|---|---|---|---|
| 5,310,492 | A * | 5/1994 | Seiki et al. | 252/68 |
| 5,536,881 | A | 7/1996 | Kawaguchi et al. | |
| 5,547,593 | A | 8/1996 | Sanechika et al. | |
| 5,639,719 | A | 6/1997 | Tanaka et al. | |
| 6,193,906 | B1 * | 2/2001 | Kaneko et al. | 252/68 |
| 6,261,474 | B1 | 7/2001 | Egawa et al. | |
| 6,355,186 | B1 * | 3/2002 | Shimomura et al. | 252/68 |
| 6,458,288 | B1 | 10/2002 | Kawaguchi et al. | |
| 6,475,405 | B1 | 11/2002 | Kawaguchi et al. | |
| 6,752,065 | B2 * | 6/2004 | Sugioka et al. | 92/12.2 |
| 7,517,839 | B2 | 4/2009 | Kawaguchi et al. | |
| 7,531,488 | B2 | 5/2009 | Kawaguchi et al. | |
| 7,927,503 | B2 | 4/2011 | Nagao et al. | |
| 2002/0077255 | A1 * | 6/2002 | Kawaguchi et al. | 508/579 |
| 2003/0127622 | A1 | 7/2003 | Kawaguchi et al. | |
| 2004/0224856 | A1 * | 11/2004 | Saiki et al. | 508/108 |
| 2006/0166844 | A1 * | 7/2006 | Egawa et al. | 508/579 |
| 2007/0225180 | A1 * | 9/2007 | Tamoto | 508/362 |
| 2010/0005829 | A1 | 1/2010 | Kaneko et al. | |
| 2010/0005830 | A1 | 1/2010 | Kaneko et al. | |
| 2010/0025621 | A1 | 2/2010 | Kaneko et al. | |
| 2010/0037648 | A1 | 2/2010 | Kaneko et al. | |
| 2010/0071406 | A1 | 3/2010 | Kaneko et al. | |
| 2010/0132397 | A1 | 6/2010 | Kaneko et al. | |
| 2010/0139311 | A1 | 6/2010 | Nagao et al. | |

FOREIGN PATENT DOCUMENTS

| | | | |
|---|---|---|---|
| CN | 1193008 | | 9/1998 |
| CN | 1260824 | | 7/2000 |
| EP | 0 718 393 | A1 | 6/1996 |
| EP | 0 913 454 | A1 | 5/1999 |
| EP | 1018538 | | 7/2000 |
| EP | 1018538 | A1 * | 7/2000 |
| EP | 1 995 299 | A1 | 11/2008 |
| JP | 58 171487 | | 10/1983 |
| JP | 61 062596 | | 3/1986 |
| JP | 02 292395 | | 12/1990 |
| JP | 08 144975 | | 6/1996 |
| JP | 10 147682 | | 6/1998 |
| JP | 10147682 | A * | 6/1998 |
| JP | 10 204458 | | 8/1998 |
| JP | 2001 294886 | | 10/2001 |
| JP | 2005 155460 | | 6/2005 |
| JP | 2005 213447 | | 8/2005 |
| WO | 96 01301 | | 1/1996 |
| WO | WO 2004058928 | | 7/2004 |
| WO | WO 2004058928 | A1 * | 7/2004 |

OTHER PUBLICATIONS

International Search Report mailed Jan. 30, 2007, in PCT/JP2006/322009, filed Nov. 2, 2006.
U.S. Appl. No. 08/130,843, filed Oct. 4, 1993, Kawaguchi, et al.
U.S. Appl. No. 07/444,932, filed Dec. 4, 1989, Kawaguchi, et al.
Extended European Search Report issued on Nov. 25, 2011 in the corresponding European Application No. 06822927.7.
Office Action issued on Jun. 5, 2012, in CN Patent application No. 200680041981.8.

* cited by examiner

*Primary Examiner* — Pamela H Weiss
(74) *Attorney, Agent, or Firm* — Oblon, Spivak, McClelland, Maier & Neustadt, L.L.P.

(57) ABSTRACT

Provided is a refrigerating machine oil composition including a base oil which contains at least one substance selected from the group consisting of monoether compounds, alkyleneglycol diethers, and polyoxyalkyleneglycol diethers having an average repetition number of an oxyalkylene group of 2 or less as a main component, and has a kinematic viscosity at 40° C. of 1 to 8 $mm^2/s$. The refrigerating machine oil composition is preferably applied to refrigerators whose sliding parts are composed of an engineering plastic or provided with an organic coating film or an inorganic coating film. The refrigerating machine oil can improve energy-saving performance due to its low viscosity, has high sealing property and excellent load capacity, and is suitably used in various refrigeration applications, especially in closed-type refrigerators.

16 Claims, No Drawings

REFRIGERATOR OIL COMPOSITION

CROSS REFERENCE TO RELATED APPLICATION

This application is a continuation application of U.S. application Ser. No. 12/093,727, filed on May 15, 2008, which is a 371 of PCT/JP06/322009, filed on Nov. 2, 2006, and claims priority to Japanese Patent Application No. 2005-330834, filed on Nov. 15, 2005.

TECHNICAL FIELD

The present invention relates to a refrigerating machine oil composition, and more specifically, to a refrigerating machine oil composition, which can improve energy-saving performance due to its low viscosity, has high sealing property and excellent load capacity, and is suitably used in various refrigeration applications, especially in closed-type refrigerators.

BACKGROUND ART

In general, a compression refrigerator includes at least a compressor, a condenser, an expansion mechanism (such as an expansion valve), and an evaporator, and, further, a drier, and is structured such that a mixed liquid of a refrigerant and a lubricating oil (refrigerating machine oil) circulates in a closed system. In the compression refrigerator described above, a temperature in the compressor is generally high, and a temperature in the condenser is generally low, though such a general theory is not applicable to a certain kind of the compression refrigerator. Accordingly, the refrigerant and the lubricating oil must circulate in the system without undergoing phase separation in a wide temperature range from low temperature to high temperature. In general, the refrigerant and the lubricating oil have regions where they undergo phase separation at low temperature and high temperature. Moreover, the highest temperature of the region where the refrigerant and the lubricating oil undergo phase separation at low temperature is preferably −10° C. or lower, or particularly preferably −20° C. or lower. On the other hand, the lowest temperature of the region where the refrigerant and the lubricating oil undergo phase separation at high temperature is preferably 30° C. or higher, or particularly preferably 40° C. or higher. The occurrence of the phase separation during the operation of the refrigerator adversely affects a lifetime or efficiency of the refrigerator to a remarkable extent. For example, when the phase separation of the refrigerant and the lubricating oil occurs in the compressor portion, a movable part is insufficiently lubricated, with the result that baking or the like occurs to shorten the lifetime of the refrigerator remarkably. On the other hand, when the phase separation occurs in the evaporator, the lubricating oil having a high viscosity is present, with the result that the efficiency of heat exchange reduces.

A chlorofluorocarbon (CFC), a hydrochlorofluorocarbon (HCFC), or the like has been heretofore mainly used as a refrigerant for a refrigerator. However, such compounds each contain chlorine that is responsible for environmental issues, so investigation has been conducted for a chlorine-free alternative refrigerant such as a hydrofluorocarbon (HFC). However, HFC may also be involved in global warming, so the so-called natural refrigerant such as hydrocarbon, ammonium, or carbon dioxide has been attracting attention as a refrigerant additionally suitable for environmental protection.

Because the lubricating oil for a refrigerator is used to lubricate a movable part of a refrigerator, its lubricating performance is obviously important. In particular, because an inside of a compressor becomes high temperature, viscosity that enables to retain an oil film required for lubrication is important. As for required viscosity which differs according to the type and use conditions of a compressor in use, the viscosity (kinematic viscosity) of a lubricating oil before it is mixed with a refrigerant is preferably 10 to 200 $mm^2/s$ at 40° C. It is said that when the viscosity is lower than it, an oil film becomes thin and a lubrication failure readily occurs and when the viscosity is higher than it, heat exchange efficiency lowers.

For instance, there is disclosed a lubricating oil composition for vapor compression refrigerators which use a carbon dioxide as a refrigerant, including a lubricating oil base oil having a 10% distillation point measured by a gas chromatograph distillation method of 400° C. or higher and a 80% distillation point of 600° C. or lower, a kinematic viscosity at 100° C. of 2 to 30 $mm^2/s$, and a viscosity index of 100 or more as a main component (for example, see Patent Document 1).

The kinematic viscosity at 40° C. of the base oil used in this lubricating oil composition is 17 to 70 $mm^2/s$ in Examples.

When the refrigerating machine oil having such a high viscosity is used, the large consumption of energy in a refrigerator cannot be dispensed with. Thus, investigation has been recently conducted for a reduction in viscosity of refrigerating machine oil or an improvement in frictional characteristic of the oil in lubrication with a view to saving energy consumed by a refrigerator.

The energy-saving property of, for example, a refrigerator for a refrigerator has been improved by reducing the viscosity of refrigerating machine oil to VG32, 22, 15, or 10. However, an additional reduction in viscosity has involved the emergence of problems such as reductions in sealing property and lubricity of the oil.

[Patent Document 1] Japanese Patent Application Laid-Open (kokai) No. 2001-294886

DISCLOSURE OF THE INVENTION

Problems to be Solved by the Invention

It is an object of the present invention to provide a refrigerating machine oil composition which can improve energy-saving performance due to its low viscosity, has high sealing property and excellent load capacity, and is suitably used in various refrigeration applications, especially in closed-type refrigerators.

Means for Solving the Problems

The inventors of the present invention have conducted intensive studies to develop a refrigerating machine oil composition which has the above preferred properties and have found that the above object can be attained by using a base oil containing an ether compound having a specific low viscosity as a main component. The present invention has been accomplished based on this finding.

That is, the present invention provides:

(1) a refrigerating machine oil composition, including a base oil which contains at least one substance selected from a monoether compound, an alkylene glycol diether, and a polyoxyalkylene glycol diether whose average repetition number of an oxyalkylene group is 2 or less as a main component, and has a kinematic viscosity at 40° C. of 1 to 8 $mm^2/s$;

(2) a refrigerating machine oil composition according to item (1), in which a molecular weight of the base oil is 140 to 660;

(3) a refrigerating machine oil composition according to item (1), in which a flash point of the base oil is 100° C. or higher;

(4) a refrigerating machine oil composition according to item (1), in which the monoether compound is a compound represented by the following general formula (I):

$$R^1—O—R^2 \quad (I)$$

where $R^1$ represents a monovalent hydrocarbon group having 7 to 25 carbon atoms, $R^2$ represents a monovalent hydrocarbon group having 1 to 20 carbon atoms, and the total number of carbon atoms of those groups is 10 to 45;

(5) a refrigerating machine oil composition according to item (1), in which the alkylene glycol diether and the polyoxyalkylene glycol diether whose average repetition number of the oxyalkylene group is 2 or less is a compound represented by the following general formula (II):

$$R^3—(OR^4)_n—OR^5 \quad (II)$$

where $R^3$ and $R^5$ each independently represent a monovalent hydrocarbon group having 1 to 20 carbon atoms, $R^4$ represents an alkylene group having 2 to 10 carbon atoms, n represents an average value having 1 to 2, and the total number of carbon atoms of those groups is 9 to 44;

(6) a refrigerating machine oil composition according to item (1), including at least one additive selected from an extreme-pressure agent, an oiliness agent, an antioxidant, an acid scavenger and an antifoaming agent;

(7) a refrigerating machine oil composition according to item (1), which is used in a refrigerator using a hydrocarbon-based, carbon dioxide-based, hydrofluorocarbon-based, or ammonia-based refrigerant;

(8) a refrigerating machine oil composition according to item (7), which is used in a refrigerator using a hydrocarbon-based refrigerant;

(9) a refrigerating machine oil composition according to item (7), in which a sliding part of the refrigerator is formed of an engineering plastic or has an organic coating film or an inorganic coating film;

(10) a refrigerating machine oil composition according to item (9), in which the organic coating film is a polytetrafluoroethylene coating film, a polyimide coating film, or a polyamide-imide coating film;

(11) a refrigerating machine oil composition according to item (9), wherein the inorganic coating film is a graphite film, a diamond-like carbon film, a tin film, a chromium film, a nickel film, or a molybdenum film;

(12) a refrigerating machine oil composition according to item (1), which is used in a car air-conditioner, a gas heat pump, an air conditioner, a refrigerator, an automatic vending machine, a show case, a hot water supply system, or a refrigerating and heating system; and

(13) a refrigerating machine oil composition according to item (12), in which a water content in the system is 60 ppm by mass or less and a residual air content therein is 8 kPa or less.

Effect of the Invention

According to the present invention, there can be provided a refrigerating machine oil composition which can improve energy-saving performance owing to its low viscosity, has high sealing property and excellent load capacity, and is suitably used in various refrigeration applications, especially in closed-type refrigerators.

BEST MODE FOR CARRYING OUT THE INVENTION

A base oil containing an ether compound as a major component is used in the refrigerating machine oil composition of the present invention. The expression "containing as a main component" herein means that the ether compound is contained in an amount of 50 mass % or more. The preferred content of the ether compound in the base oil is preferably 70 mass or more, more preferably 90 mass % or more, much more preferably 100 mass %.

In the present invention, the kinematic viscosity at 40° C. of the base oil is 1 to 8 $mm^2/s$. When the kinematic viscosity is 1 $mm^2/s$ or more, load capacity is fully obtained and sealing property becomes high, and when the kinematic viscosity is 8 $mm^2/s$ or less, the effect of improving energy-saving performance is fully obtained. The kinematic viscosity at 40° C. is preferably 1 to 6 $mm^2/s$, more preferably 2 $mm^2/s$ or more and less than 5 $mm^2/s$.

The molecular weight of the base oil is preferably 140 to 660, more preferably 140 to 340, and much more preferably 200 to 320. When the molecular weight falls within the above range, a desired kinematic viscosity can be obtained. The flash point is preferably 100° C. or higher, more preferably 130° C. or higher, and much more preferably 150° C. or higher. The molecular weight distribution (weight average molecular weight/number average molecular weight) of the base oil is preferably 1.5 or less, more preferably 1.2 or less.

In the present invention, another base oil may be used in combination with the ether compound in an amount of 50 mass % or less, preferably 30 mass % or less, and more preferably 10 mass % or less if it has the above properties, but it is more preferred that the another base oil not be used.

Examples of the base oil which can be used in combination with the ether compound include polyvinyl ethers, polyoxyalkylene glycol derivatives, hydrogenation products of an α-olefin oligomer, mineral oils, alicyclic hydrocarbon compounds, and alkylated aromatic hydrocarbon compounds.

In the present invention, the major component of the base oil is at least one substance selected from a monoether compound, alkylene glycol diether, and polyoxyalkylene glycol diether whose average repetition number of a oxyalkylene group is 2 or less. The above monoether compound is represented, for example, by the following general formula (I):

$$R^1—O—R^2 \quad (I)$$

where $R^1$ represents a monovalent hydrocarbon group having 7 to 25 carbon atoms, $R^2$ represents a monovalent hydrocarbon group having 1 to 20 carbon atoms, and the total number of carbon atoms of those groups is 10 to 45.

In the above general formula (I), examples of the monovalent hydrocarbon group having 7 to 25 carbon atoms represented by $R^1$ include a linear or branched alkyl group or alkenyl group. Examples of $R^1$ include various octyl groups, various decyl groups, various dodecyl groups, various tetradecyl groups, various hexadecyl groups, various octadecyl groups, and various icosyl groups.

On the other hand, examples of the monovalent hydrocarbon group having 1 to 20 carbon atoms and represented by $R^2$ include a linear, branched, or cyclic alkyl group or alkenyl group each having 1 to 20 carbon atoms, an aryl group having 6 to 20 carbon atoms, or an aralkyl group having 7 to 20 carbon atoms. Specific examples of $R^2$ include a methyl group, an ethyl group, various propyl groups, various butyl groups, various pentyl groups, various hexyl groups, various heptyl groups, various octyl groups, various nonyl groups, various decyl groups, various dodecyl groups, various tetradecyl groups, a cyclopentyl group, a cyclohexyl group, an allyl group, a propenyl group, various butenyl groups, various hexenyl groups, various octenyl groups, various decenyl groups, a cyclopentenyl group, a cyclohexenyl group, a phenyl group, a tolyl group, a naphthyl group, a benzyl group, and a phenethyl group.

As the monoether compound represented by the general formula (I), a compound having a total carbon atoms of 10 to 23 is preferred. Specifically, decylmethyl ether, decylethyl ether, decylpropyl ether, decylbutyl ether, decylpentyl ether, decylhexyl ether, decyloctyl ether, didecyl ether, dodecylmethyl ether, dodecylethyl ether, dodecylpropyl ether, dodecylbutyl ether, dodecylpentyl ether, dodecylhexyl ether, dodecyloctyl ether, dodecyldecyl ether, tetradecylmethyl ether, tetradecylethyl ether, tetradecylpropyl ether, tetradecylbutyl ether, tetradecylpentyl ether, tetradecylhexyl ether, tetradecyloctyl ether, hexadecylmethyl ether, hexadecylethyl ether, hexadecylpropyl ether, hexadecylbutyl ether, hexadecylpentyl ether, hexadecylhexyl ether, octadecylmethyl ether, octadecylethyl ether, octadecylpropyl ether, and octadecylbutyl ether are exemplified.

Meanwhile, a compound represented by the following general formula (II) may be used as the alkylene glycol diether and the polyoxyalkylene glycol diether whose average repetition number of the oxyalkylene group is 2 or less:

$$R^3—(OR^4)_n—OR^5 \quad (II)$$

where $R^3$ and $R^5$ each independently represent a monovalent hydrocarbon group having 1 to 20 carbon atoms, $R^4$ represent an alkylene group having 2 to 10 carbon atoms, n represent an average value having 1 to 2, and the total number of carbon atoms of those groups is 9 to 44.

Examples of the monovalent hydrocarbon group having 1 to 20 carbon atoms represented by $R^3$ and $R^5$ include a linear, branched, or cyclic alkyl group or alkenyl group having 1 to 20 carbon atoms, aryl group each having 6 to 20 carbon atoms or aralkyl groups having 7 to 20 carbon atoms. Examples of $R^3$ and $R^5$ are the same as those listed for $R^2$ of the above general formula (I). $R^3$ and $R^5$ may be the same as or different from each other.

The alkylene group having 2 to 10 carbon atoms and represented by $R^4$ may be any one of linear, branched, or cyclic one. For example, an ethylene group, a propylene group, a trimethylene group, various butylene groups, various pentylene groups, various hexylene groups, various octylene groups, various decylene groups, a cyclopentylene group, and a cyclohexylene group are mentioned.

As the alkylene glycol diether and the polyoxyalkylene glycol diether whose average repetition number of an oxyalkylene group is 2 or less, which are represented by the general formula (II), polyoxyalkylene glycol diether having the total carbon atoms of 9 to 22 is preferred. Specifically, ethyleneglycoldipentylether, ethyleneglycol dihexylether, ethyleneglycol dioctylether, ethyleneglycol octyldecylether, ethyleneglycol didecylether, diethyleneglycol dibutylether, diethyleneglycol dipentylether, diethyleneglycol dihexylether, diethyleneglycol dioctylether, propyleneglycol dibutylether, propyleneglycol dipentylether, propyleneglycol dihexylether, propyleneglycol dioctylether, dipropyleneglycol diethylether, dipropyleneglycol dipropylether, dipropyleneglycol dibutylether, dipropyleneglycol dipentylether, and dipropyleneglycol dihexylether are exemplified.

In the present invention, one kind or two or more kinds selected from the above compounds is used as the ether compound to ensure that the kinematic viscosity at 40° C. of the base oil becomes 1 to 8 $mm^2/s$, preferably 1 to 6 $mm^2/s$, and more preferably 2 to 5 $mm^2/s$.

The refrigerating machine oil composition of the present invention may contain at least one additive selected from an extreme-pressure agent, oiliness agent, an antioxidant, an acid scavenger, and an antifoaming agent.

Examples of the extreme-pressure agent include phosphorus-based extreme-pressure agents formed of phosphates, acidic phosphates, phosphites, acidic phosphites, or amine salts thereof.

Of those phosphorus-based extreme-pressure agents, tricresyl phosphate, trithiophenyl phosphate, tri(nonylphenyl) phosphite, dioleyl hydrogen phosphite, and 2-ethylhexyldiphenyl phosphite are particularly preferred from the viewpoints of extreme pressure property and abrasion property.

A metal salt of a carboxylic acid may also be used as the extreme-pressure agent. The metal salt of a carboxylic acid is preferably a metal salt of a carboxylic acid having 3 to 60 carbon atoms, more preferably a metal salt of a fatty acid having 3 to 30 carbon atoms, specifically 12 to 30 carbon atoms. Examples of the extreme-pressure agent include metal salts of dimer acid and trimer acid of the fatty acid and metal salts of a carboxylic acid having 3 to 30 carbon atoms. Of those, metal salts of a fatty acid having 12 to 30 carbon atoms and metal salts of a dicarboxylic acid having 3 to 30 carbon atoms are particularly preferred.

Meanwhile, an alkali metal or alkali earth metal is preferred and an alkali metal is particularly preferred as a metal constituting the metal salt.

Further, example of extreme-pressure agents other than the ones mentioned above include sulfur-based extreme-pressure agents formed of sulfurized oil and fat, fatty acid sulfides, sulfide esters, sulfide olefins, dihydrocarbyl polysulfides, thiocarbamates, thioterpenes, or dialkylthio dipropionates.

The amount of the extreme-pressure agent is generally 0.001 to 5 mass %, particularly preferably 0.005 to 3 mass % based on the total amount of the composition from the viewpoints of lubricity and stability.

The extreme-pressure agents may be used alone or in combination of two or more.

Examples of the oiliness agent include: aliphatic saturated or unsaturated monocarboxylic acids such as stearic acid and oleic acid; polymers of fatty acid such as dimer acid and hydrogenated dimer acid; hydroxy fatty acids such as ricinoleic acid and 12-hydroxystearic acid; saturated or unsaturated fatty monoalcohols such as laurylalcohol and oleylalcohol; saturated or unsaturated fatty monoamines such as atearylamine and oleylamine; saturated or unsaturated fatty monocarboxylic amides such as lauric acid amide and oleic acid amide; and partially esters of polyalcohols such as glycerine and sorbitol and saturated or unsaturated aliphatic monocarboxylic acid.

They may be used alone or in combination of two or more. The amount of the oiliness agent is generally 0.01 to 10 mass %, preferably 0.1 to 5 mass % based on the total amount of the composition.

Examples of the antioxidant include: phenol-based antioxidants formed of 2,6-di-tert-butyl-4-methylphenol, 2,6-di-tert-butyl-4-ethylphenol, and 2,2'-methylenebis(4-methyl-6-tert-butylphenol); and amine-based antioxidants formed of phenyl-α-naphthylamine and N,N'-di-phenyl-p-phenylenediamine. The antioxidant is contained in the composition in an amount of generally 0.01 to 5 mass %, preferably 0.05 to 3 mass % from the viewpoint of efficacy and economic efficiency.

As the acid scavenger, for example, phenylglycidylether, alkylglycidylether, alkyleneglycol glycidylether, cyclohexeneoxide, α-olefinoxide, and an epoxy compound such as epoxidized soybean oil are mentioned. Of those, phenylglycidylether, alkylglycidylether, alkyleneglycol glycidylether, cyclohexeneoxide, and α-olefinoxide are preferred from the viewpoint of compatibility.

The alkyl group of the alkyl glycidyl ether and the alkylene group of the alkylene glycol glycidyl ether may have a branch and have generally 3 to 30, preferably 4 to 24, particularly preferably 6 to 16 carbon atoms. Ana-olefin oxide having 4 to 50, preferably 4 to 24, particularly preferably 6 to 16 carbon atoms is used as the α-olefin oxide. In the present invention, the acid scavengers may be used alone or in combination of two or more. The amount of the acid scavenger is generally 0.005 to 5 mass %, particularly preferably 0.05 to 3 mass based on the composition from the viewpoint of efficacy and the suppression of the production of sludge.

In the present invention, the stability of the refrigerating machine oil composition can be improved by using the acid scavenger. The effect of further improving the stability is obtained by using the extreme-pressure agent and antioxidant in combination with the acid scavenger.

Examples of the antifoaming agent include silicone oil and fluorinated silicone oil.

Other known additives such as a copper inactivating agent exemplified by N—[N,N'-dialkyl(alkyl group having 3 to 12 carbon atoms)aminomethyl]tolutriazole may be suitably added to the refrigerating machine oil composition of the present invention in a range not inhibiting the object of the present invention.

The refrigerating machine oil composition of the present invention is used in refrigerators using a hydrocarbon-based, carbon dioxide-based, hydrofluorocarbon-based, or ammonia-based refrigerant, especially refrigerators using a hydrocarbon-based refrigerant.

As for the amounts of the refrigerant and the refrigerating machine oil composition in the method of lubricating a refrigerator using the refrigerating machine oil composition of the present invention, the mass ratio of the refrigerant to the refrigerating machine oil composition is 99/1 to 10/90, preferably 95/5 to 30/70. When the amount of the refrigerant falls below the above range, a reduction in refrigerating capability is observed and when the amount exceeds the above range, lubricating performance degrades disadvantageously, which are not preferable. Although the refrigerating machine oil composition of the present invention can be used in various refrigerators, it is preferably used in the compression refrigeration cycle of a compression refrigerator.

The refrigerator in which the refrigerating machine oil composition of the present invention is used has a refrigeration cycle essentially composed of: a compressor, a condenser, an expansion mechanism (such as an expansion valve), and an evaporator; or a compressor, a condenser, an expansion mechanism, a drier, and an evaporator. The refrigerator in which the refrigerating machine oil composition of the present invention is used uses the refrigerating machine oil composition of the present invention as a refrigerating machine oil and the above refrigerant as a refrigerant.

A desiccant composed of zeolite having a pore diameter of 0.33 nm or less is preferably charged into the drier. Examples of the zeolite include natural zeolite and synthetic zeolite. Further, the zeolite preferably has a $CO_2$ gas absorption capacity of 1.0% or less at 25° C. and at a $CO_2$ gas partial pressure of 33 kPa. Examples of the synthetic zeolite include the XH-9 and XH-600 (trade names) manufactured by Union Showa Co., Ltd.

In the present invention, use of this desiccant makes it possible to remove water efficiently and suppress powderization caused by the deterioration of the desiccant itself at the same time without absorbing the refrigerant in the refrigeration cycle. Therefore, there is no possibility of the blockage of a pipe caused by powderization and abnormal abrasion caused by entry into the sliding part of a compressor, thereby making it possible to operate the refrigerator stably for a long time.

Various sliding parts (such as bearing) are present in a compressor in a refrigerator to which the refrigerating machine oil composition of the present invention is applied. In the present invention, a part composed of engineering plastic, or a part having an organic or inorganic coating film is preferably used as each of the sliding parts in terms of, in particular, sealing property.

Preferable examples of the engineering plastic include a polyamide resin, a polyphenylene sulfide resin, and a polyacetal resin in terms of sealing property, sliding property, and abrasion resistance.

In addition, examples of the organic coating film include a fluorine-containing resin coating film (such as polytetrafluoroethylene coating film), a polyimide coating film, and a polyamideimide coating film in terms of sealing property, sliding property, and abrasion resistance.

On the other hand, examples of the inorganic coating film include a graphite film, a diamond-like carbon film, a nickel film, a molybdenum film, a tin film, and a chromium film in terms of sealing property, sliding property, and abrasion resistance. The inorganic coating film may be formed by a plating treatment or a physical vapor deposition method (PVD).

Further, a part composed of a conventional alloy system such as an Fe base alloy, an Al base alloy, or a Cu base alloy can also be used as each of the sliding parts.

The refrigerating machine oil composition of the present invention may be used in car air-conditioners, gas heat pumps, air-conditioners, cool storages, automatic vending machines, show cases, hot water supply systems, or refrigerating and heating systems.

In the present invention, the water content in the system is preferably 60 ppm by mass or less, more preferably 50 ppm by mass or less. The amount of the residual air in the system is preferably 8 kPa or less, more preferably 7 kPa or less.

The refrigerating machine oil composition of the present invention contains an ether compound as a main component of its base oil, can improve energy-saving performance due to its low viscosity and has excellent load capacity.

EXAMPLES

The following examples are provided for the purpose of further illustrating the present invention but are in no way to be taken as limiting.

The properties of the base oil and the properties of the refrigerating machine oil composition were obtained by the following procedures.

<Properties of Base Oil>

(1) 40° C. Kinematic Viscosity

This was measured with a glass capillary type viscometer in accordance with JIS K2283-1983.

(2) Flash Point

This was measured by a C.O.C. method in accordance with JIS K2265.

<Properties of Refrigerating Machine Oil Composition>

(3) Baking Load

This was measured with a Falex baking tester in accordance with ASTM D 3233. The measurement conditions include a revolution of 290 rpm, a pin material of AISIC1137, a block material of SAE3135, and a refrigerant (isobutane) blow rate of 5 L/h.

(4) Sealed Tube Test

A Fe/Cu/Al catalyst was put into a glass tube, a sample oil/refrigerant (isobutane) were charged into the glass tube in a ratio of 4 mL/1 g, and the glass tube was sealed and kept at 175° C. for 30 days to check the external appearance of the oil, the external appearance of the catalyst, the existence of sludge, and the acid value.

(5) Short-Circuit Test

A short-circuit tester (reciprocating refrigerator, capillary length of 1 m) was used to carry out a durability test for 1,000 hours at a Pd (discharge pressure)/Ps (suction pressure) of 3.3/0.4 MPa, a Td (discharge temperature)/Ts (suction temperature) of 110/30° C., and a test oil/R600a (isobutane) ratio of 400/400 g, so as to measure the reduction rate of the capillary flow rate after the test.

(6) Sealing Property Comparison Test

Various sliding materials were used in the piston to compare the amount of blow-by from the space between the piston and the cylinder. The amount of blow-by is a relative comparison value when the value of Reference Example 1 is 12.

Examples 1 to 9 and Comparative Examples 1 to 3

The refrigerating machine oil compositions having compositions shown in Table 1 were prepared, their baking loads were measured, and a sealed tube test was performed. The results are shown in Table 1.

TABLE 1

| | | | Example 1 | Example 2 | Example 3 | Example 4 | Example 5 | Example 6 | Example 7 |
|---|---|---|---|---|---|---|---|---|---|
| | | | Sample oil No. | | | | | | |
| | | | Sample oil 1 | Sample oil 2 | Sample oil 3 | Sample oil 4 | Sample oil 5 | Sample oil 6 | Sample oil 7 |
| Amount (mass %) | Base oil | A1 | Balance | | | Balance | | | Balance |
| | | A2 | | Balance | | | Balance | | |
| | | A3 | | | Balance | | | Balance | |
| | | B1 | | | | | | | |
| | | B2 | | | | | | | |
| | Extreme-pressure agent | C1 | 1 | 1 | 1 | | | | 0.5 |
| | Extreme-pressure agent | C2 | | | | 1 | 1 | 1 | |
| | Acid scavenger | C3 | 1 | 1 | 1 | 1 | 1 | 1 | 1 |
| | Antioxidant | C4 | 0.5 | 0.5 | 0.5 | 0.5 | 0.5 | 0.5 | 0.5 |
| | Antifoaming agent | C5 | 0.001 | 0.001 | 0.001 | 0.001 | 0.001 | 0.001 | 0.001 |
| Baking loads | | (N) | 1,800 | 2,950 | 2,340 | 2,150 | 2,500 | 2,300 | 1,660 |
| Result of sealed tube test | | External appearance of the oil | Good | Good | Good | Good | Good | Good | Good |
| | | External appearance of the catalyst | Good | Good | Good | Good | Good | Good | Good |
| | | Existence of sludge | None | None | None | None | None | None | None |
| | | Acid value (mgKOH/g) | 0.01> | 0.01> | 0.01> | 0.01> | 0.01> | 0.01> | 0.01> |
| External appearance at −10° C. | | | Liquid | Liquid | Liquid | Liquid | Liquid | Liquid | Liquid |

| | | | Example 8 | Example 9 | Comparative Example 1 | Comparative Example 2 | Comparative Example 3 |
|---|---|---|---|---|---|---|---|
| | | | Sample oil No. | | | | |
| | | | Sample oil 8 | Sample oil 9 | Sample oil 10 | Sample Oil 11 | Sample oil 12 |
| Amount (mass %) | Base oil | A1 | | | | | |
| | | A2 | Balance | | | | |
| | | A3 | | Balance | | | |
| | | B1 | | | Balance | 100 | |
| | | B2 | | | | | Balance |
| | Extreme-pressure agent | C1 | 0.5 | | 1 | | 0.5 |
| | Extreme-pressure agent | C2 | | 0.5 | | | |
| | Acid scavenger | C3 | 1 | 1 | 1 | | 1 |
| | Antioxidant | C4 | 0.5 | 0.5 | 0.5 | | 0.5 |

TABLE 1-continued

| | | | | | | |
|---|---|---|---|---|---|---|
| Antifoaming agent | C5 | 0.001 | 0.001 | 0.001 | | 0.001 |
| Baking loads | (N) | 2,100 | 2,000 | 260 | 250 | 1,900 |
| Result of sealed tube test | External appearance of the oil | Good | Good | Good | Good | Good |
| | External appearance of the catalyst | Good | Good | Good | Good | Good |
| | Existence of sludge | None | None | None | None | None |
| | Acid value (mgKOH/g) | 0.01> | 0.01> | 0.01> | 0.01> | 0.01> |
| External appearance at −10° C. | | Liquid | Liquid | Liquid | Liquid | Solid |

(Notes)
A1: didecyl ether having a kinematic viscosity of 4.9 $mm^2/s$ at 40° C., flash point at 183° C., molecular weight of 298, and molecular weight distribution of 1
A2: hexadecyl methylether having a kinematic viscosity of 3.6 $mm^2/s$ at 40° C., flash point at 162° C., molecular weight of 256, and molecular weight distribution of 1
A3: ethyleneglycol dioctylether having a kinematic viscosity of 5.3 $mm^2/s$ at 40° C., flash point at 175° C., molecular weight of 286, and molecular weight distribution of 1
B1: silicone oil having a kinematic viscosity of 10 $mm^2/s$ at 40° C.
B2: n-hexadecane
C1: tricresylphosphate
C2: trithiophenylphosphate
C3: $C_{14}$-α-olefinoxide
C4: 2,6-di-t-butyl-4-methylphenol
C5: silicone-based antifoaming agent It is understood from Table 1 that the refrigerating machine oil compositions (Examples 1 to 9) of the present invention have a higher baking load than those of Comparative Examples 1 and 2 and that they have a good sealed tube test result. Although the composition of Comparative Example 3 has a relatively high baking load, it is solid at −10° C.

Examples 10 to 15 and Comparative Examples 4 to 6

A short-circuit test was performed on sample oils shown in Table 2. The results are shown in Table 2.

TABLE 2

| | | Example 10 | Example 11 | Example 12 | Example 13 | Example 14 |
|---|---|---|---|---|---|---|
| | | Sample oil No. | | | | |
| | | Sample oil 1 | Sample oil 2 | Sample oil 3 | Sample oil 4 | Sample oil 5 |
| Condition of short-circuit test | Water content in the system (ppm) | 30 | 30 | 30 | 50 | 50 |
| | Residual air content (kPa) | 4 | 4 | 4 | 4 | 6.7 |
| Result of short-circuit test | Reduction rate of the capillary flow rate (%) | 3> | 3> | 3> | 3> | 3> |
| | External appearance of the oil | Good | Good | Good | Good | Good |
| | Acid value (mgKOH/g) | 0.01> | 0.01> | 0.01> | 0.01> | 0.01> |
| Remarks | | | | | | |

| | | Example 15 | Comparative Example 4 | Comparative Example 5 | Comparative Example 6 |
|---|---|---|---|---|---|
| | | Sample oil No. | | | |
| | | Sample oil 6 | Sample oil 10 | Sample oil 11 | Sample oil 12 |
| Condition of short-circuit test | Water content in the system (ppm) | 30 | 30 | 30 | 30 |
| | Residual air content (kPa) | 6.7 | 4 | 4 | 4 |

TABLE 2-continued

| | | | | | |
|---|---|---|---|---|---|
| Result of short-circuit test | Reduction rate of the capillary flow rate (%) | 3> | — | — | — |
| | External appearance of the oil | Good | — | — | — |
| | Acid value (mgKOH/g) | 0.01> | — | — | — |
| Remarks | | | Comp baking | Comp baking | Blockage of a capillary |

As understood from Table 2, the refrigerating machine oil compositions of Examples 10 to 15 have a water content in the system of less than 60 ppm by mass and a residual air content of less than 8 kPa. Therefore, they have a good short-circuit test result.

In Comparative Examples 4 to 6, the baking of a compressor and the blocking of a capillary occurred in the short-circuit test.

Examples 16 to 19 and Reference Example 1

A sealing property comparison test was made on the sample oils shown in Table 3 by using sliding materials shown in Table 3. The results are shown in Table 3.

TABLE 3

| | Example 16 | Example 17 | Example 18 | Example 19 | Reference Example 1 |
|---|---|---|---|---|---|
| Sample oil No. | Sample oil 1 | Sample oil 2 | Sample oil 3 | Sample oil 3 | Sample oil 3 |
| Sliding material | D1 | D2 | D3 | D4 | D5 |
| Amount of blow-by (relative comparison) | 7 | 5 | 6 | 10 | 12 |

(Notes)
D1: polyphenylenesulfide
D2: polymer coating film containing fluorine
D3: coating film containing polyimide
D4: tin plating film
D5: aluminium alloy It is understood from Table 3 that the amount of blow-by of Examples 16 to 19 is smaller than that of Reference Example 1. Therefore, sealing property is satisfactory.

INDUSTRIAL APPLICABILITY

The refrigerating machine oil composition of the present invention can improve energy-saving performance due to its low viscosity, has high sealing property and excellent load capacity, and is suitably used in various refrigeration applications, especially in closed-type refrigerators.

The invention claimed is:

1. A composition, comprising a refrigerant and a refrigerating machine oil composition, wherein said refrigerating machine oil composition comprises a base oil consisting of a monoether compound represented by the following general formula (I):

$$R^1—O—R^2 \quad (I)$$

where $R^1$ represents a monovalent hydrocarbon group having 7 to 25 carbon atoms, $R^2$ represents a monovalent hydrocarbon group having 1 to 20 carbon atoms, and the total number of carbon atoms of $R^1$ and $R^2$ is 10 to 45, wherein the base oil has a kinematic viscosity at 40° C. of 1 to 8 $mm^2/s$, and wherein the refrigerant consists of isobutane.

2. The composition according to claim 1, wherein the base oil has a molecular weight of 140 to 660.

3. The composition according to claim 1, wherein the base oil has a flash point of 100° C. or higher.

4. The composition according to claim 1, comprising at least one additive selected from the group consisting of an extreme-pressure agent, an oiliness agent, an antioxidant, an acid scavenger and an antifoaming agent.

5. A refrigerator comprising the composition according to claim 1.

6. The refrigerator according to claim 5, wherein the refrigerator comprises a sliding part comprising an engineering plastic, an organic coating film or an inorganic coating film.

7. The refrigerator according to claim 5, wherein the refrigerator comprises a sliding part comprising an organic coating film, wherein said organic coating film comprises a polytetrafluoroethylene coating film, a polyimide coating film, or a polyamide-imide coating film.

8. The refrigerator according to claim 5, wherein the refrigerator comprises a sliding part comprising a coating film, wherein said coating film comprises a graphite film, a diamond-like carbon film, a tin film, a chromium film, a nickel film, or a molybdenum film.

9. The composition according to claim 1, wherein in formula (I) the monovalent hydrocarbon group having 7 to 25 carbon atoms is a linear or branched alkyl group or alkenyl group.

10. The composition according to claim 1, wherein in formula (I) the monovalent hydrocarbon group having 7 to 25 carbon atoms is selected from the group consisting of an octyl group, a decyl group, a dodecyl group, a tetradecyl group, a hexadecyl group, an octadecyl group, and an icosyl group.

11. The composition according to claim 1, wherein in formula (I) the monovalent hydrocarbon group having 1 to 20 carbon atoms is a linear, branched, or cyclic alkyl group or alkenyl group each having 1 to 20 carbon atoms, an aryl group having 6 to 20 carbon atoms, or an aralkyl group having 7 to 20 carbon atoms.

12. The composition according to claim 1, wherein in formula (I) the monovalent hydrocarbon group having 1 to 20 carbon atoms is selected from the group consisting of a methyl group, an ethyl group, a propyl group, a butyl group, a pentyl group, a hexyl group, a heptyl group, an octyl group, a nonyl group, a decyl group, a dodecyl group, a tetradecyl group, a cyclopentyl group, a cyclohexyl group, an allyl group, a propenyl group, a butenyl group, a hexenyl group, a octenyl group, a decenyl group, a cyclopentenyl group, a cyclohexenyl group, a phenyl group, a tolyl group, a naphthyl group, a benzyl group, and a phenethyl group.

13. The composition according to claim 1, wherein the monoether compound represented by formula (I) is a compound having a total carbon atoms of 10 to 23.

14. The composition according to claim 1, wherein the monoether compound represented by formula (I) is a compound selected from the group consisting of decylmethyl ether, decylethyl ether, decylpropyl ether, decylbutyl ether, decylpentyl ether, decylhexyl ether, decyloctyl ether, didecyl ether, dodecylmethyl ether, dodecylethyl ether, dodecylpropyl ether, dodecylbutyl ether, dodecylpentyl ether, dodecylhexyl ether, dodecyloctyl ether, dodecyldecyl ether, tetradecylmethyl ether, tetradecylethyl ether, tetradecylpropyl ether, tetradecylbutyl ether, tetradecylpentyl ether, tetradecylhexyl ether, tetradecyloctyl ether, hexadecylmethyl ether, hexadecylethyl ether, hexadecylpropyl ether, hexadecylbutyl ether, hexadecylpentyl ether, hexadecylhexyl ether, octadecylmethyl ether, octadecylethyl ether, octadecylpropyl ether, and octadecylbutyl ether.

15. A method of refrigerating comprising circulating the composition of claim 1 in a refrigerator.

16. A method of refrigerating comprising circulating the composition of claim 1 in a car air-conditioner, a gas heat pump, an air conditioner, a refrigerator, an automatic vending machine, a show case, a hot water supply system, or a refrigerating and heating system.

* * * * *